US005115972A

United States Patent [19]

Maier et al.

[11] Patent Number: 5,115,972

[45] Date of Patent: May 26, 1992

[54] SPRAY DIE FOR PRODUCING SPRAY FANS

[75] Inventors: Gary W. Maier, Warren, Wis.; Sharon Wang, Woodbury, Minn.

[73] Assignee: Minnesota Mining and Manufacturing Company, St. Paul, Minn.

[21] Appl. No.: 651,147

[22] Filed: Feb. 6, 1991

[51] Int. Cl.[5] ..... A62C 5/02; B05B 1/28

[52] U.S. Cl. ..... 239/8; 239/297; 239/299; 239/544; 239/549

[58] Field of Search ..... 239/112, 113, 8, 295, 239/296, 297, 299, 424.5, 543, 544, 549

[56] References Cited

U.S. PATENT DOCUMENTS

| | | | |
|---|---|---|---|
| 4,232,824 | 11/1980 | Binoche | 239/296 X |
| 4,502,629 | 3/1985 | McGhee et al. | 239/296 X |
| 4,657,184 | 4/1987 | Weinstein | 239/296 |
| 4,793,559 | 12/1988 | Marlek | 239/722 |
| 4,830,279 | 5/1989 | Crum et al. | 239/3 |
| 4,887,771 | 12/1989 | Marlek | 239/722 |
| 4,995,333 | 2/1991 | Keller et al. | 239/296 X |

FOREIGN PATENT DOCUMENTS 0347058 12/1989 European Pat. Off. .

OTHER PUBLICATIONS

Spraying Systems Co. Catalog No. 50A (selected excerpts).

*Primary Examiner*—Andres Kashnikow
*Assistant Examiner*—Lesley D. Morris
*Attorney, Agent, or Firm*—Gary L. Griswold; Walter N. Kirn; Charles D. Levine

[57] ABSTRACT

A spray die for applying a substantially uniform, continuous coating of fluid onto a substrate is disclosed. The spray die includes a plurality of fluid nozzles which are disposed linearly to eject a two-dimensional spray fan of fluid onto the substrate. The diameter of each fluid nozzle is selected in combination with the flow rate and viscosity of the ejected fluid. A pair of air nozzles is disposed on opposite sides of each fluid nozzle to provide a pair of opposing air streams which impinge on the fluid nozzle behind the orifice of the nozzle.

12 Claims, 4 Drawing Sheets

SPRAY DIE FOR PRODUCING SPRAY FANS

TECHNICAL FIELD

The present invention relates to spray dies. More particularly, the present invention relates to spray dies which produce spray fans for providing a uniform coating on a substrate.

BACKGROUND OF THE INVENTION

Spray dies and spray nozzles are commonly used in such diverse environments as spray coating, dust control, and fuel injection, among others. Various types of spray dies are used to provide a wide range of resulting sprays. Narrow streams, and circular, flat, and hollow sprays are just a few examples. Sprays can be produced with or without mixing air and the fluid being sprayed to atomize the fluid particles. When air is used, the air can be mixed within the fluid nozzle or outside of the fluid nozzle. Air blast systems, in which a moving air stream mixes with a fluid stream outside of the fluid nozzle, are the focus of this specification.

Conventional spray coating techniques, whether used to apply permanent coatings to a substrate or to moisturize a substrate as part of a more complex process, typically use spray nozzles which produce conical or flat sprays or streams of fluid onto the substrate. These sprays can range in width from several to over thirty centimeters. One typical spray nozzle is disclosed in U.S. Pat. No. 4,830,279 to Crum et al. In this patent, a flat spray nozzle for a single nozzle powder spray gun is disclosed. The nozzle has a dual opening with a single passageway. Before the powder is sprayed, it is electrostatically charged and mixed with air within the nozzle.

Most substrates treated in the web preparation and handling fields typically have widths between one and two meters. To achieve full fluid coverage of substrates of this size or larger, a series of side-by-side spray nozzles must be used. Two patents issued to Marlek, U.S. Pat. Nos. 4,793,559 and 4,887,771, are directed to pressurized liquid chemical applicators for use on large area horizontal surfaces. However, in order to provide sufficient coverage of the sprayed fluid across the entire width of the substrate, the spray nozzles of these applicators must be closely located so that the conical sprays overlap. This causes bands of high and low coating weight, resulting in an unevenly treated substrate.

E.P.0. Publication No. 0 347 058 discloses a flat pattern nozzle for use in coating printed circuit boards. The coating can be accomplished with airless spraying, using an atomized high pressure stream, or air spraying, in which air impinges against the liquid stream to atomize the stream.

As illustrated in a spray nozzle catalog No. 50A of Spraying Systems Co., air blast spray systems in which the air stream creates turbulent flow to atomize the fluid outside of the fluid nozzle are also known. These systems impinge the air stream directly into the fluid stream.

These known spraying apparatus are deficient in a number of ways. None of the known air blast spraying apparatus mixes a fluid stream or spray with air outside the fluid nozzle by impinging the air just behind the fluid nozzle orifice to coat a substrate. None of these apparatus can coat a substrate with a uniform, continuous coating of fluid without unacceptable coating weight variations, and none can coat with only a small portion of wasted coating material.

SUMMARY OF THE INVENTION

The present invention is directed to a spray die for applying a substantially uniform coating of fluid onto a substrate with reduced coating weight variation. The spray die includes at least one and preferably a plurality of fluid nozzles which eject fluid onto the substrate. Preferably, the fluid nozzles are disposed linearly to create a two-dimensional spray fan. The diameter of each fluid nozzle is selected in combination with the flow rate and viscosity of the ejected fluid. The fluid nozzles are preferably removably mounted to a fluid manifold using screw threads which allow quick, easy replacement of plugged or damaged nozzles. The spray die also can include valves which selectively open and close any of the fluid nozzles.

The fluid manifold transports fluid to each nozzle and a fluid source provides fluid to the fluid manifold. A pair of gas nozzles is disposed on opposite sides of each fluid nozzle to provide a pair of opposing gas streams which impinge on the fluid nozzle behind the orifice of the nozzle. The gas nozzles preferably discharge air. The fluid manifold, fluid nozzle, and air nozzles are disposed in a housing.

The air nozzles each have an orifice disposed adjacent to each fluid nozzle to provide an air stream which impinges on the fluid nozzle behind the orifice of the fluid nozzle. The air nozzle is located such that the perpendicular distance from each air nozzle orifice to its respective fluid nozzle permits the air stream to retain the dimensions with minimal expansion of its air nozzle orifice until the air impinges on the fluid nozzle. Each air nozzle is oriented to eject air to impinge on the fluid nozzle adjacent the fluid nozzle orifice without directly contacting fluid exiting the fluid nozzle.

In an alternative embodiment, the fluid nozzles protrude through a slot in the air manifold. The air stream discharged through the air nozzles causes ambient air to be pulled through the slot in the direction of fluid flow to reduce stagnant areas adjacent the fluid nozzles and prevent build-up of fluid on the face of the die. As a further modification, a blower can discharge air through the slot in the direction of fluid flow to reduce stagnant areas adjacent the fluid nozzles.

The spray die can be used to eject a moisturizing fluid onto paper or cloth webs to replace, in a controlled manner, moisture lost during drying. The spray die can also be used to eject a coating material for use with antistats, primers, release coating, saturants, adhesives, paints, or other materials. These are just two of the many coating uses to which the spray die of the present invention can be put.

DETAILED DESCRIPTION OF PREFERRED EMBODIMENTS

The spray apparatus of the present invention can be used for the non-contact application of a controlled coating on a substrate. The coating can be uniform or nonuniform, continuous or discontinuous. The coating is applied with a minimum of overspray and a maximum level of control. The spray die of this invention attains vast improvements over the existing spray apparatus. The spray die typically results in less than 10% wasted coating fluid in the web direction. This allows excellent crossweb width control and maintains clean edges. In existing overlapping conical spray apparatus, typically, over 70% of the coating fluid can be wasted either through excessive overlapping or by not being discharged onto the substrate.

The apparatus can be used with low viscosity fluid solutions as well as with hot melt materials when the various components of the apparatus are sufficiently heated. The spray apparatus is a spray die 10 which applies a substantially uniform, continuous coating of fluid onto a substrate with little coating weight variation. Alternatively, the spray die 10 can be used to apply discontinuous coatings such as stripes. The spray die 10 will be described for use in applying coatings, which can include hot melt materials, low viscosity fluids, and moisturizers such as water. The coating material can be antistats, primers, release coatings, saturants, adhesives, paints, or other materials.

Figure 1:
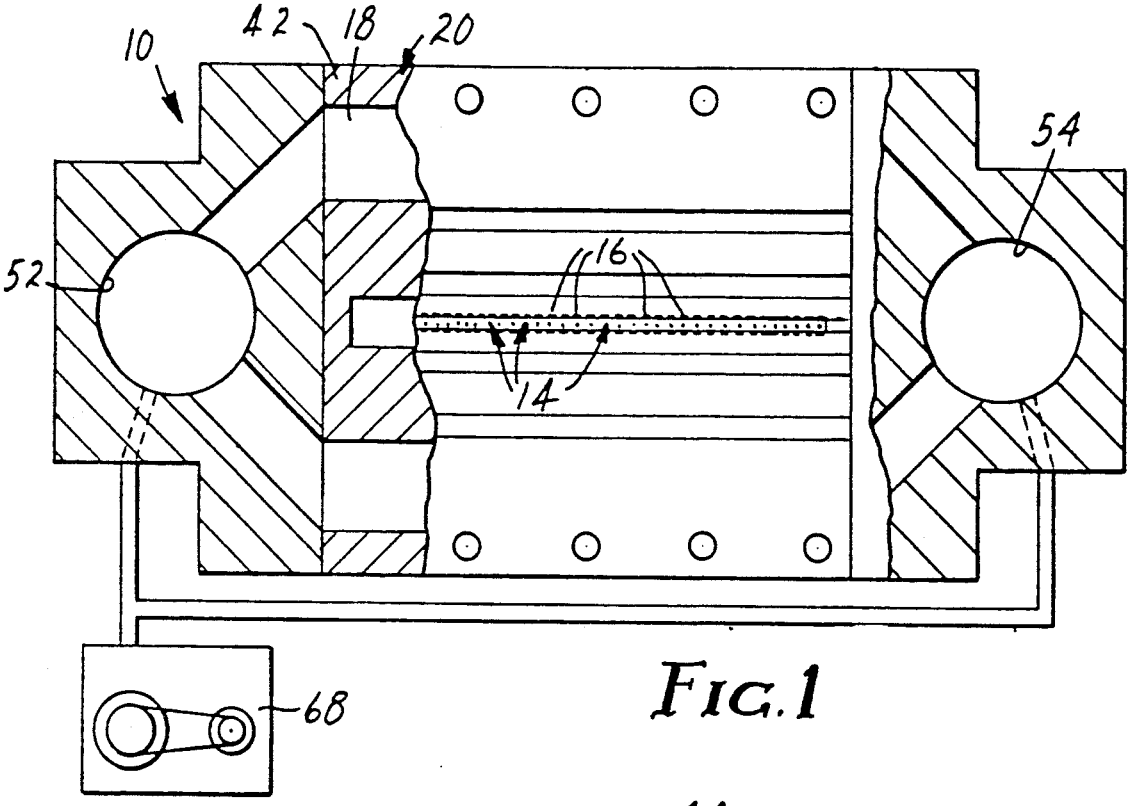
FIG. 1 is a front partial cross-sectional view of the spray die of the present invention with the sides pulled out to show detail.
Figure 3:
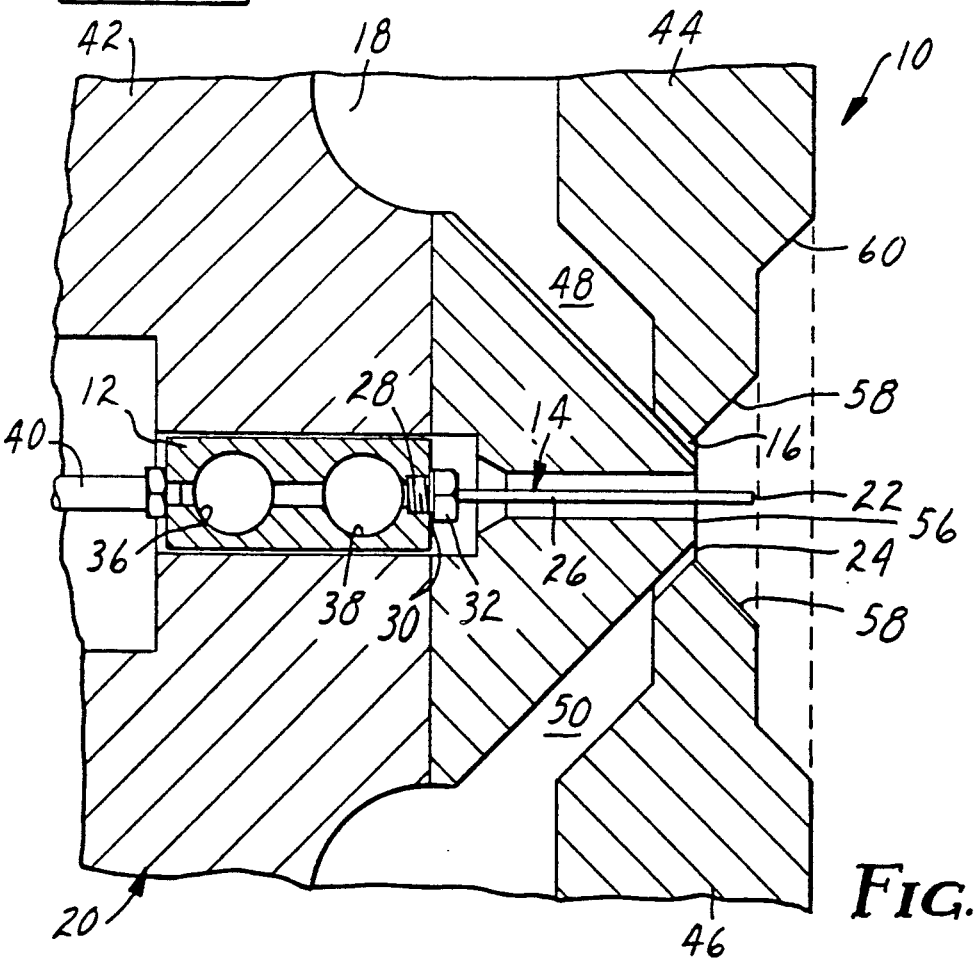
FIG. 3 is an enlarged, detailed cross-sectional view of the spray die of FIG. 1.
Figure 5:
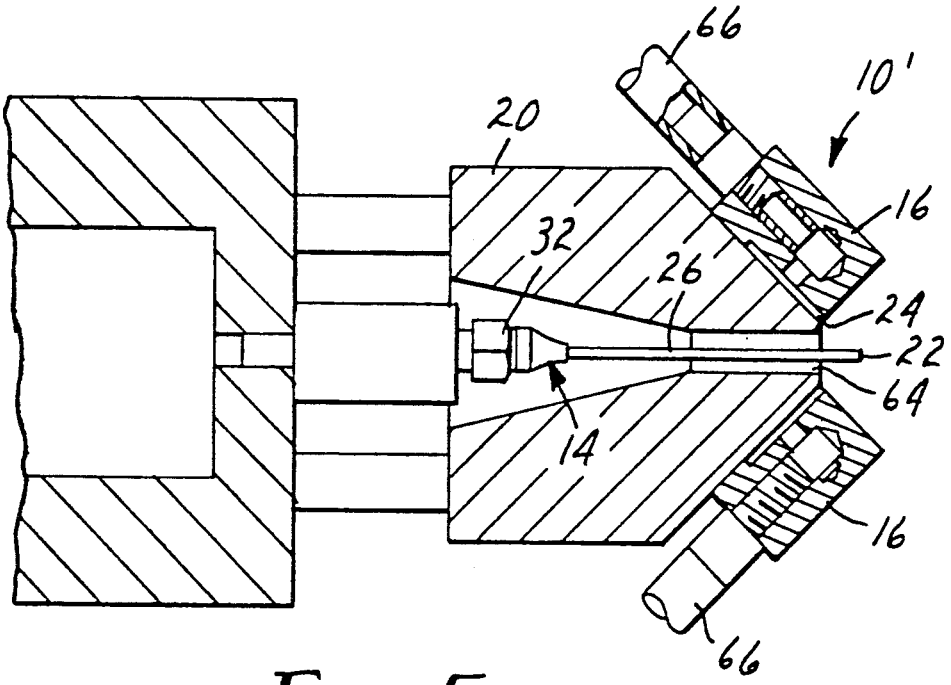
FIG. 5 is a side view, partially in cross section, of the fluid and air orifices of the spray die of FIG. 4.
Figure 2:
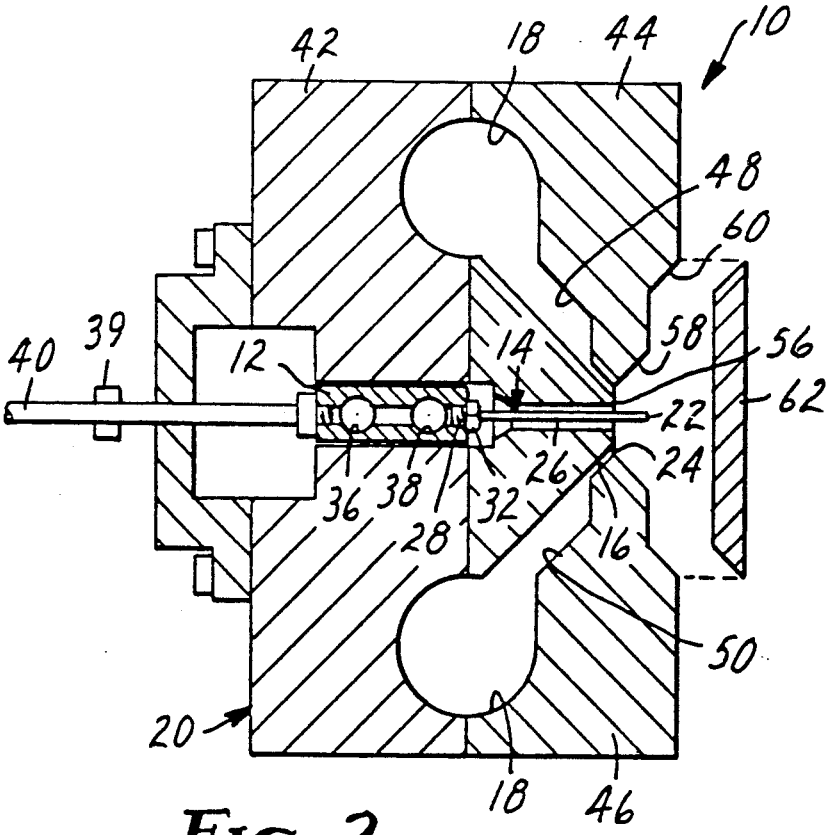
FIG. 2 is a side cross-sectional view of the spray die of FIG. 1.
Figure 4:
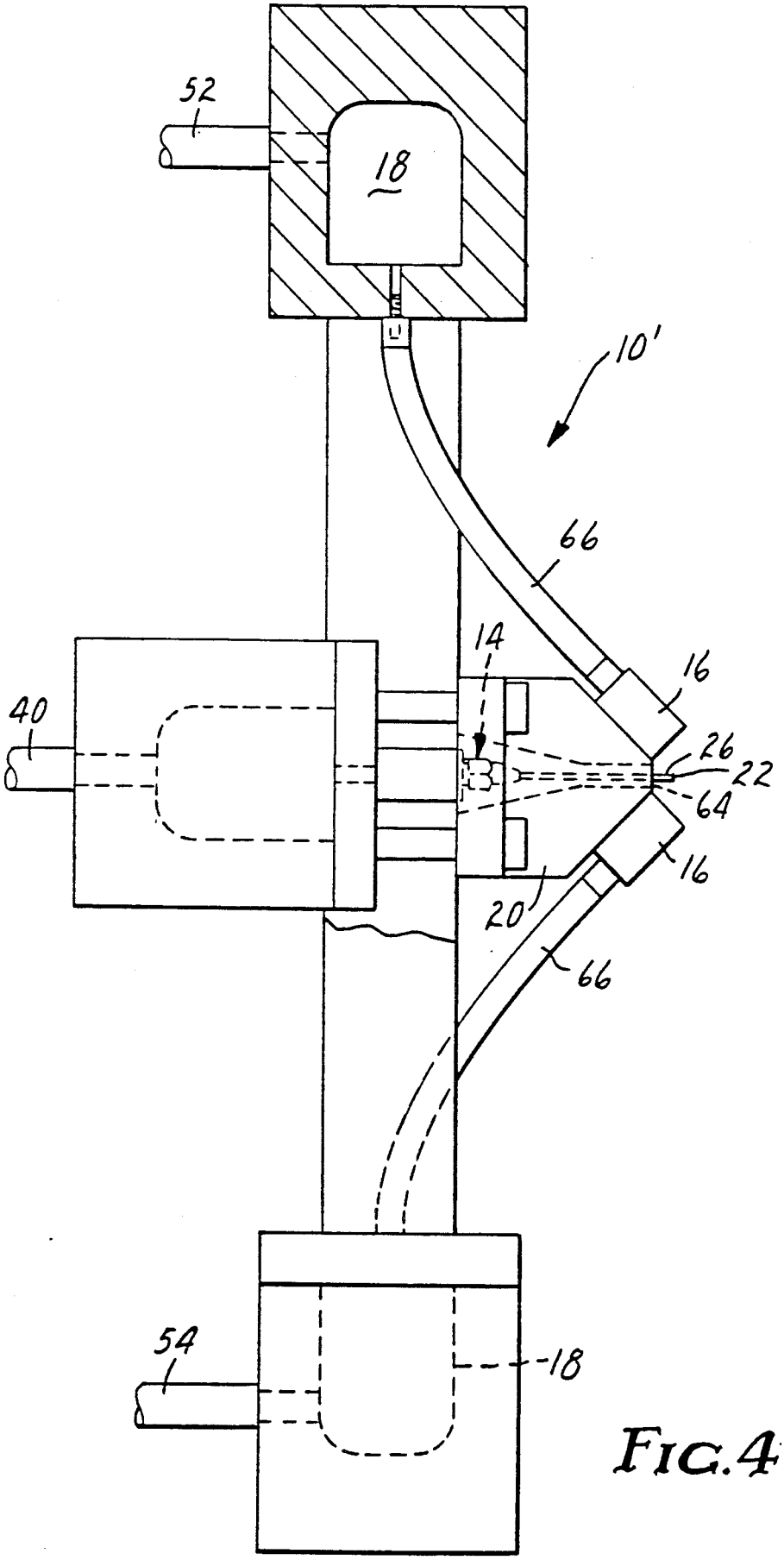
FIG. 4 is a side view, partially in cross section, of the spray die according to another embodiment of the present invention.

Referring to FIGS. 1-3, the spray die 10 includes a fluid manifold 12 and a plurality of fluid nozzles 14 connected to the fluid manifold 12. A pair of gas nozzles such as air nozzles 16 is disposed adjacent to each fluid nozzle 14. Although air nozzles 16 are used, other gases, such as steam (for hot melt adhesives) and nitrogen (for moisture activated silicone), can be used. The air nozzles 16 are formed as the outlets from an air manifold 18. These primary components are disposed in a housing 20 which is simply the air manifold 18.

In order to optimize the control over the fluid spray and to minimize overspraying and fluid waste, the air nozzles 16 should direct the air so that the air impinges on the fluid nozzle 14 immediately behind the fluid nozzle orifice 22. Thus, each air nozzle 16 is oriented to eject air to impinge on the fluid nozzle 14 without contacting the fluid until after the air contacts the fluid nozzle 14. Ideally, the air should contact the fluid nozzle 14 at the orifice 22. If the air directly impinges on the fluid exiting the fluid nozzle 14, excess fluid dispersion would result in a wasteful fog. If the air impinges on the fluid nozzle 14 too far back of the fluid nozzle orifice 22, increased air flow would be required to produce the desired atomization. The perpendicular distance from each air nozzle orifice 24 to its respective fluid nozzle 14 is selected to permit the air stream to maintain the air nozzle orifice 24 dimensions with minimal expansion until the air impinges on the fluid nozzle 14.

At least one and preferably a plurality of fluid nozzles 14 eject fluid onto the substrate. The spacing of the fluid nozzles 14 is selected to achieve the desired spray fan size. The line of fluid nozzles 14 is generally perpendicular to the direction of substrate travel and should be long enough to coat substrates of a maximum desired width. Preferably, the fluid nozzles 14 are disposed linearly and are spaced within 1.5 cm of each other to create a two-dimensional spray fan. The diameter of each fluid nozzle 14 is selected in combination with the flow rate and viscosity of the ejected fluid and, preferably the fluid nozzle orifice 22 is circular.

Additionally, the pressure of the fluid in the nozzles 14 can be varied. For example, it is preferred to operate at lower pressures and high volume where the fluid is broken into droplets and atomized by the impinging air and the fluid emerges as a spray. At higher pressures, the fluid will emerge from the nozzles 14 in a stream. At pressures above a critical pressure, the fluid will emerge from the nozzle 14 as a spray even without air impingement due to the surface disturbances caused by the high pressures.

The fluid nozzles 14 preferably are removable blunt end tubes 26 mounted to the fluid manifold 12 using a screw thread 28 which allows quick, easy replacement of plugged or damaged nozzles 14. This also permits changing nozzles 14 to use nozzles 14 having different orifice 22 areas to accommodate different fluids or to change the spray width. A rubber or plastic gasket 30 seals the fluid nozzles 14 to the fluid manifold 12. Alternatively, other fastening methods can be used. Regardless of the fastening method, the nozzles 14 should be configured so that there is a fixed distance from the orifice 22 of the nozzle 14 to the plane of the base 32 of the tube 26 which contacts the fluid manifold 12.

The fluid manifold 12 is mounted within an opening in the housing 20 which can be holes or a slot. The distance from the nozzle orifices 22 to the substrate to be treated is adjustable by adjusting the position of the fluid manifold 12 within the housing 20 as with a threaded screw adjustment 39. The fluid manifold 12 distributes fluid to each fluid nozzle 14 from a fluid source and includes two manifold portions 36, 38 to allow improved distribution of the fluid. Fluid leaving the fluid source enters the lower manifold portion 36 through an axially central fluid passageway 40. After fluid fills the lower manifold portion 36, it fills the upper manifold portion 38, before traveling to the fluid nozzles 14.

There are various ways to change the operating length of the spray die 10. When shorter width substrates than the maximum width are coated, the spray die 10 can be angled with the perpendicular to shorten the operating length of the spray die 10. Alternatively, a plurality of fluid manifolds 12, each having a different number of fluid nozzle tubes 26 (with the unused fluid nozzle openings being plugged), can alternately be placed in the housing 20 to vary the coating width. Also, the fluid nozzle tubes 26 can be removed from or replaced in the fluid manifold 12 (with the unused fluid nozzle openings being plugged) depending on the desired coating width. Additionally, the spray die 10 can include valves (not shown) which selectively open and close any of the fluid nozzles 14 to vary the fluid coating coverage on the substrate.

The air nozzles 16 are disposed on opposite sides of each fluid nozzle 14 to provide a pair of opposing air streams which impinge against the fluid nozzle 14 immediately behind the fluid nozzle orifice 22. The opposing air streams cause the air to symmetrically impinge against the fluid nozzle 14 from opposite sides to yield a relatively thin fluid fan, the most efficient shape for uniformly coating a moving substrate. The air nozzles 16 need not be physically located on opposite sides of the fluid nozzle 14 as long as the resulting air streams oppose each other. Depending on the use, in alternative embodiments a single air nozzle 16 could be used at each fluid nozzle 14 although it would tend to push the fluid to one side. Also, more than two nozzles 16 can be used depending on the desired dimensions of the spray. For example, four air nozzles 16, two on each side of the fluid nozzle 14, can be used.

Figure 6:
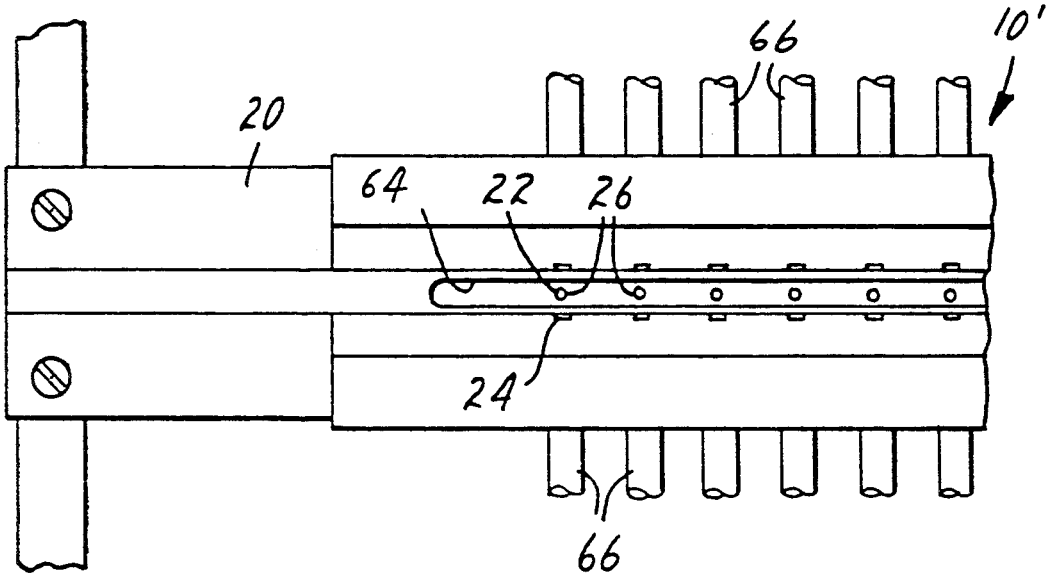
FIG. 6 is a front view of the spray die of FIG. 4.

The air nozzles 16 are spaced center-to-center approximately 0.3 to 0.4 cm apart from each other. Additionally, the cross-sectional area of the air nozzle orifice 24 is selected based on the properties of the fluid used as the coating. Although the air nozzle orifice 24 can be circular, rectangular flat orifices are preferred to flatten the atomized fluid spray, as best shown in FIG. 6. The width of a flat orifice 24 can range between 0.25 and 0.50 mm while the length is typically 3 to 7 mm. The length is selected to minimize overspray and air waste in the intended environment. It is also useful in some applications, to form the air nozzles 16 for all of the fluid nozzles 14 on one side of the fluid nozzle 14 as a single orifice extending for the length of the entire line of fluid nozzles 14.

The angle at which the air nozzles 16 direct air toward the fluid nozzles 14 is selected in combination with the flow rate and viscosity of the ejected fluid, depending on the desired geometry of the spray or stream that is ejected. Typically, the angles on a given apparatus will be customized and fixed for a particular application, although adjustable air nozzles 16 can be used. Angles with the axis of the fluid nozzles 16 typically range from 40° to 60°. At angles below 10°, there is not enough air impingement to atomize the fluid and the ejected fluid emerges like a stream. At angles above 170°, there is too much atomization and large clouds of fluid emerge which result in wasted fluid. The preferred angle is in the range of 45° to 55°. Below the preferred angle range, the apparatus can still function, but an increased air flow rate is required to attain the same atomization level.

In the embodiment of FIGS. 1-3, the air nozzles 16 are formed as passages in the air manifold 18 which is itself formed of three components and serves as the spray die housing 20. The air manifold 18 includes a base portion 42 and two upper portions 44, 46 and the air nozzles 16 are formed within the upper portions 44, 46 adjacent the base portion 42 on each side of the die 10. The air nozzles 16 extend from two air passageways 48, 50 are filled through two air inlets 52, 54, one at each end of the air manifold 18. Alternatively, the air nozzles 16 can be rigid or flexible tubes 66 extending from the air manifold 18 to the air nozzle orifices 24 adjacent the fluid nozzles 14, as shown in the embodiment of FIG. 4-7, discussed below.

The die face 56 preferably is shaped such that the fluid nozzles 14 extend beyond the adjacent portion of the die face 56. This adjacent portion is bounded by angled walls 58 which are parallel to the direction of travel of the air stream from the air nozzles 16. Additionally, the line of fluid nozzles 14 and air nozzles 16 is further recessed 60 from the external plane of the spray die face 56 with the fluid nozzle orifices 22 disposed below the plane of the recess 60. This enables the spray die 10 to receive a cover 62 which protects the nozzles 14, 16 during storage, shipping, and other periods of non-use. When in place, the cover is flush with the external plane of the spray die face 56.

In the embodiment of FIGS. 1-3, the fluid nozzles 14 are disposed in the housing 20 through individual openings with minimum clearance. This apparatus is used when the spray die 10 is used to moisturize a substrate with water or to coat with fluids which will not affect the operation of the spray die 10 if they should be deposited on the die face 56.

Referring now to FIGS. 4-7, the spray die 10' is similar to that of FIGS. 1-3 and includes a fluid manifold 12 terminating in a plurality of fluid nozzles 14, and an air manifold 18 terminating in a pair of air nozzles 16 disposed adjacent to each fluid nozzle 14. The air nozzles 16 direct the air so that the air impinges on the fluid nozzle 14 immediately behind the fluid nozzle orifice 22. The fluid nozzles 14 include removable tubes 26 mounted to the fluid manifold 12 using a screw thread 28.

Figure 7:
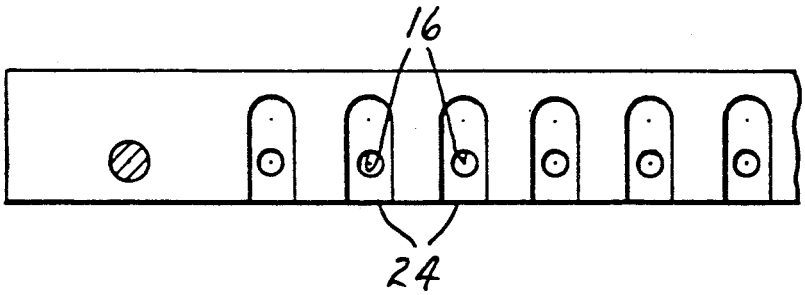
FIG. 7 is a bottom view of the nozzle slot of the spray die of FIG. 4.

This embodiment differs from that of FIGS. 1-3 in that the fluid nozzles 14 of the spray die 10' are mounted in a slot 64 in the housing 20 which provides space around the fluid nozzles 14 between the fluid nozzles 14 and the slot walls. The air stream discharged through the air nozzles 16 causes ambient air to be pulled through the slot 64 in the direction of fluid flow. This eliminates eddies and reduces stagnant areas adjacent the fluid nozzles 14 to prevent build-up of fluid on the die face 56. FIG. 7 is a bottom view of the slot 64 showing the fluid nozzles 14 and the air nozzles 16. As a further modification, a blower can discharge air to maintain a constant flow through the slot 64 in the direction of fluid flow to reduce stagnant areas adjacent the fluid nozzles 14.

The method of uniformly applying a substantially uniform, continuous coating of fluid onto a substrate includes transporting fluid to each nozzle 14 from a fluid manifold 12, ejecting fluid onto the substrate through the fluid nozzles 14, and impinging a pair of opposing air streams on each fluid nozzle 14 behind the orifice 22 of the nozzle 14 using air nozzles 16 to create the two-dimensional spray fan.

Numerous characteristics, advantages, and embodiments of the invention have been described in detail in the foregoing description with reference to the accompanying drawings. However, the disclosure is illustrative only and the invention is not intended to be limited to the precise embodiments illustrated. Various changes and modifications may be effected therein by one skilled in the art without departing from the scope or spirit of the invention.

We claim:

1. A low pressure high volume spray die for applying a substantially controlled coating of fluid onto a substrate comprising:

a housing;

at least one fluid nozzle mounted in the housing and having an orifice for ejecting fluid onto the substrate;

a fluid manifold mounted in the housing for receiving and distributing fluid to each nozzle;

at least one gas nozzle mounted in the housing and having an orifice disposed adjacent each fluid nozzle to provide a gas stream which impinges on the fluid nozzle behind the orifice of the fluid nozzle such that substantially all of the gas does not contact the fluid until after it contacts the fluid nozzle and the perpendicular distance from each gas nozzle orifice to its respective fluid nozzle is adjusted to help maintain the dimensions of the gas stream as those of the gas nozzle orifice until the gas impinges on the fluid nozzle to form atomized droplets of the sprayed fluid.

2. The spray die of claim 1 further comprising a pair of gas nozzles disposed on opposite sides of each fluid nozzle to produce a pair of opposing gas streams.

3. The spray die of claim 1 wherein the diameter of each fluid nozzle is adjusted in combination with the flow rate and viscosity of the ejected fluid.

4. The spray die of claim 3 wherein the shape and angle of each gas nozzle is adjusted in combination with the flow rate and viscosity of the ejected fluid.

5. The spray die of claim 1 wherein a plurality of fluid nozzles are mounted in the housing.

6. The spray die of claim 5 further comprising means for selectively opening and closing any of the fluid nozzles.

7. The spray die of claim 5 wherein the fluid nozzles are removably mounted to the fluid manifold.

8. A low pressure high volume spray die for applying a substantially controlled coating of fluid onto a substrate comprising:

a housing;

a plurality of fluid nozzles mounted in the housing and each having an orifice for ejecting fluid onto the substrate;

a fluid manifold mounted in the housing for receiving and distributing fluid to each nozzle;

at least one gas nozzle mounted in the housing and having an orifice disposed adjacent each fluid nozzle to provide a gas stream which impinges on the fluid nozzle behind the orifice of the fluid nozzle such that substantially all of the gas does not contact the fluid until after it contacts the fluid nozzle and the perpendicular distance from each gas nozzle orifice to its respective fluid nozzle is adjusted to help maintain the dimensions of the gas stream as those of the gas nozzle orifice until the gas impinges on the fluid nozzle to form atomized droplets of the sprayed fluid;

wherein the housing has a slot and the fluid nozzles are mounted through the slot, and wherein the gas stream discharged through the gas nozzles causes ambient air to be pulled through the slot in the direction of fluid flow to reduce stagnant areas adjacent the fluid nozzles and prevent build-up of fluid on the housing face.

9. The spray die of claim 5 wherein the fluid nozzles are disposed linearly to create a two-dimensional spray fan along a predetermined width, and further comprising a fluid source for providing fluid to the fluid manifold, and a gas manifold mounted in the housing for transporting gas to each of the gas nozzles.

10. A method of uniformly applying a controlled coating of fluid onto a substrate comprising the steps of:

providing fluid to a fluid manifold;

transporting fluid to fluid nozzles from the fluid manifold;

ejecting fluid onto the substrate through the orifices of the fluid nozzles;

impinging at least one gas stream, from a gas nozzle having an orifice, on the fluid nozzle behind the orifice of the nozzle such that the perpendicular distance from each gas nozzle orifice to its respective fluid nozzle is adjusted to help maintain the dimensions of the gas stream as those of the gas nozzle orifice until the gas impinges on the fluid nozzle;

orienting the gas stream to impinge on the fluid nozzle adjacent to the fluid nozzle orifice to create a two-dimensional spray fan of a predetermined width adjacent each fluid nozzle;

selecting the diameter of each fluid nozzle in combination with the flow rate and viscosity of the ejected fluid; and selecting the shape and angle of each gas nozzle in combination with the flow rate and viscosity of the ejected fluid to produce sufficient atomization.

11. The method of claim 10 further comprising the step of selectively opening and closing any of the fluid nozzles.

12. The method of claim 10 wherein the impinging step comprises impinging a pair of opposing gas streams on the fluid nozzle and wherein the gas nozzles discharge air on opposite sides of the fluid nozzle.

* * * * *